United States Patent [19]

Hansen et al.

[11] 4,298,224

[45] Nov. 3, 1981

[54] EAVES CLEANING IMPLEMENT

[76] Inventors: Ralph D. Hansen; Edna C. Hansen, both of Rte. 5, Box 382, Sioux Falls, S. Dak. 57101

[21] Appl. No.: 124,122

[22] Filed: Feb. 25, 1980

[51] Int. Cl.[3] ..... A47F 13/06

[52] U.S. Cl. ..... 294/19 R

[58] Field of Search ..... 294/19 R, 55, 22, 26; 15/104.3, 236 R, 144 R, 144 B, 145, 160, 143 B; 401/9

[56] References Cited

U.S. PATENT DOCUMENTS 3,041,655 7/1962 Entler ..... 294/19 R

OTHER PUBLICATIONS

Magazine, "Popular Science Monthly" Sep., 1938, p. 68, Article Entitled *Cleans Eaves Troughs.*

*Primary Examiner*—James B. Marbert

*Attorney, Agent, or Firm*—Mawhinney & Mawhinney & Connors

[57] ABSTRACT

An implement for cleaning leaves and other debris from overhead gutters or eaves of a building by a single operator with a to-and-fro motion while standing on the ground has a cleaning tool of one-piece construction and composed of a substantially U-shaped center section from the ends of the legs of which coplanar channel-like blades extend perpendicularly in opposite directions with the blades having outer open ends. A U-shaped supporting bracket has the outer end portions of its legs fixedly attached to the outside of the legs of the center section and the bracket extends upwardly and outwardly at approximately a 45° angle so that when the tool is placed in the bottom of a gutter, the bracket extends upwardly and outwardly over and beyond the gutter with an elongated handle being attached to the bracket at its outer bight portion and depending vertically therefrom to be held by the operator for moving the tool in a back-and forth motion within a gutter.

6 Claims, 3 Drawing Figures

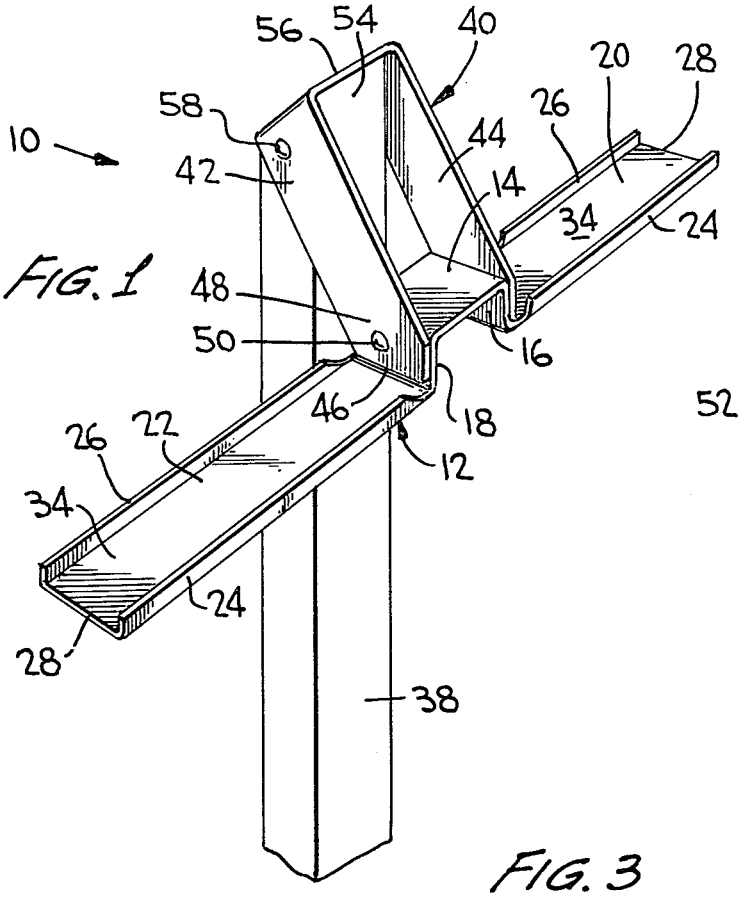
FIG. 1
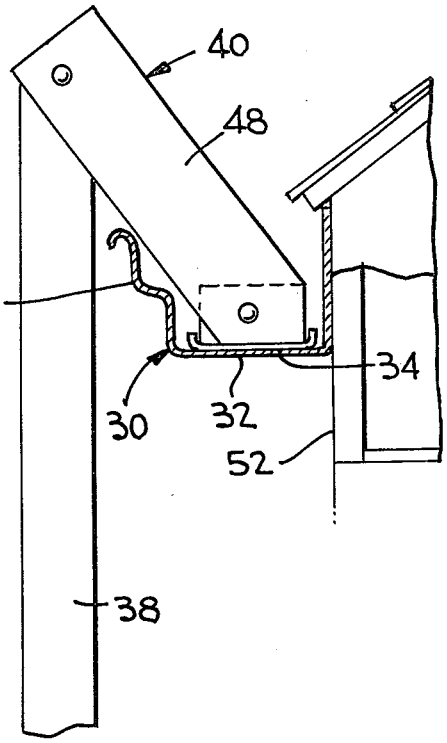
FIG. 2
FIG. 3
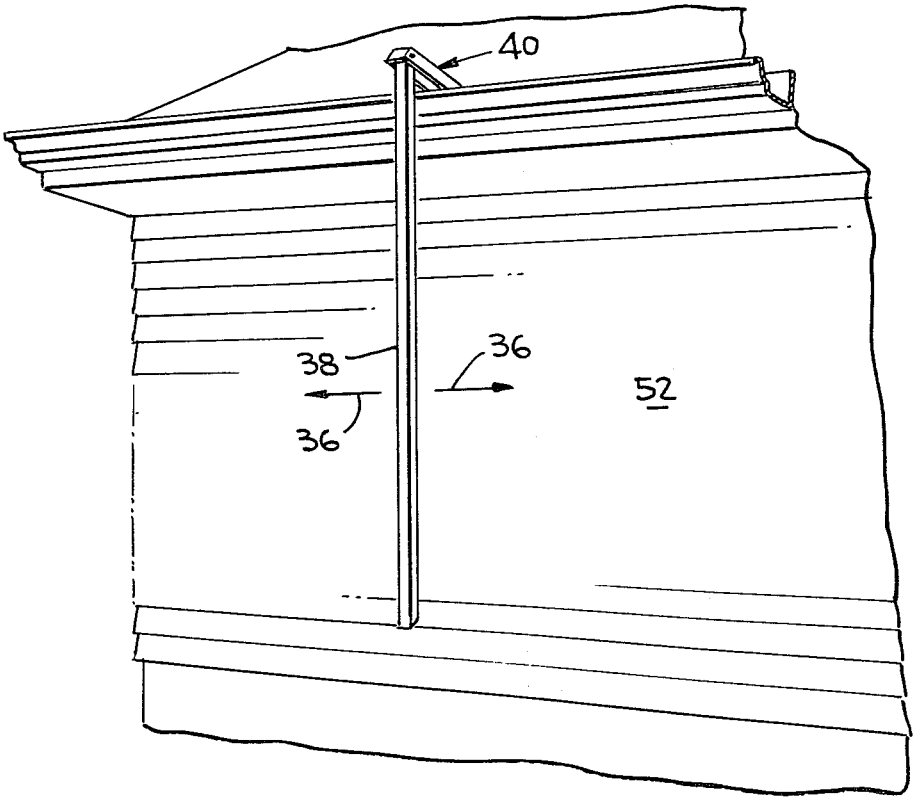

EAVES CLEANING IMPLEMENT

BACKGROUND OF THE INVENTION (1) Field of the Invention

The present invention generally relates to improvements in cleaning implements or tools and, more particularly, appertains to a new and novel apparatus or implement for remotely removing leaves and other debris from the overhead or elevated eaves or gutters of a building.

(2) State of the Prior Art

In order to eliminate the need for a person to climb on a ladder or work from the roof of a building so as to gain access to leaves and other debris which become collected in overhead or elevated roof gutters or eaves, many cleaning devices have been provided which can be manipulated and controlled by a single person standing on the ground alongside the side of the building. However, such known devices are rather complicated in mechanical structure and difficult to use or are inefficient in purpose and operation. And some of such known devices require the use of water under pressure.

With regard to such devices, there are some that have gripping jaws or arms that are mounted on the upper end of a pole and are adapted to be spring biased or otherwise merged together in a clamping relation so as to clamp onto and grasp a group of leaves and hold them in such condition for physical removal from the gutter. Such clamping or gripping jaw-type devices are disclosed in U.S. Pat. Nos. 3,743,339, 4,057,276; and 4,114,938. Such devices are mechanically very complicated and are expensive for manufacture. In addition, they are not easily used. Nor are they entirely efficient since some leaves and debris always tend to fall away from the clamped pack as the jaws or arms are lifted up and out of the gutter by upward and outward manipulation of the supporting pole.

Other types of gutter cleaning devices, such as disclosed in U.S. Pat. Nos. 3,023,971 and 3,041,655, are composed of scrapers that are mounted on the upper end of elongated handles and are moved in the gutters to scrape them while water under pressure is discharged into the gutters in front of the scrapers as they are moved along the gutters to loosen the compacted leaves therein with the water being supplied by means of hoses carried by the handles. Devices of this type are primarily for the purpose of washing the leaves along the gutters and down the vertical pipe and out the discharge spout with the scrapers being provided to loosen the leaves so that they can be washed along the gutters by the water under pressure.

In addition, there are blade-type gutter cleaners, such as disclosed in U.S. Pat. No. 3,858,267, wherein a flat thin blade is mounted on the upper end of an elongated handle so that it is positionable perpendicularly within a gutter and moved in a manner like a plow so as to pack the leaves in a solid mass at one end of the gutter. Another type of gutter cleaning tool is disclosed in U.S. Pat. No. 3,626,542, wherein a rake-like tool is held by a pole within a gutter and is used in the manner of an ordinary lawn rake.

None of such known cleaning implements or devices, as afore-described, are of a simple and inexpensive construction and are not easily and efficiently used for thorough cleaning of roof eaves or troughs.

SUMMARY OF THE INVENTION

Accordingly, it is a main object of the present invention to provide a gutter or eave cleaning implement that is extremely simple in construction and use, that is highly efficient and usable in a manner so as to not tire the operator and that is very inexpensive to manufacture and sell.

Generally considered, the eave cleaning implement of the present invention is composed of a one-piece tool which is formed from sturdy but thin and flat stock, such as sheet metal or plastics material. The tool is formed with a U-shaped center section that has opposing parallel legs from the outer free ends of which thin blades extend coplanarly in opposite directions. In the instance of eaves with flat bottoms, the blades are flat so as to conform to the flat nature of the eaves and the opposing side edges of the blades are crimped upwardly so that the blades are channel-like. The blades have outer open ends which act as the digging or scooping ends of the blades and the tool is moved in a back-and-forth motion within the gutter. In the instance where the gutter may be of semicircular cross-sectional shape or possess some degree of curvature, the blades would be rounded in conformance therewith but would still be of a channel-like configuration in cross-section and would still have the outer open ends.

A U-shaped supporting bracket has its legs provided with beveled outer ends that rest on the inner ends of the blades with the outer end portion of the legs being affixed, as by bolts or rivets, to the outer faces of the U-shaped center section of the tool. The bracket is formed and attached to the center section so that it extends from the tool at approximately a 45° angle laterally from the tool.

An elongated handle or pole has a beveled upper end which fits snugly against the inner face of the bight portion of the bracket and is fixedly fastened to the end portions of the legs of the bracket, adjacent the bight end thereof, by bolts or rivets. In this fashion, the handle lies perpendicular to the blades of the tool and is disposed outwardly of the gutter or eave by virtue of the 45° angular inclination of the attaching bracket. Thus, the tool can be moved to and fro or back and forth in the gutter by a person standing on the ground and holding the lower end of the handle.

BRIEF DESCRIPTION OF THE DRAWING

FIG. 1 is a perspective view of the gutter cleaning implement of the present invention.

FIG. 2 is an elevational view thereof, showing the tool in working position in a gutter attached to a building.

FIG. 3 is a perspective view of a building with a gutter and showing the gutter cleaning implement of the present invention in working association therewith.

DESCRIPTION OF THE PREFERRED EMBODIMENT

Referring now more particularly to the accompanying drawings, the eave or gutter cleaning implement 10 of the present invention includes a tool 12 which is of single-piece construction and is fabricated from thin but sturdy stock, such as sheet metal, tin or plastics materials. The one-piece tool 12 has a U-center section 14 which includes opposing legs 16 and 18 having lower free ends from which cleaning blades 20 and 22 extend perpendicular to the legs 16 and 18. The blades 20 and 22 project in opposite directions from the center section 14 and are disposed coplanar. The blades have their side edges crimped upwardly to form upstanding side walls 24 and 26 along the length of each blade so that the blades are channel-like in cross section. Each of the blades has an outer open scooping end 28.

In the instance of a gutter or eave 30, as shown in FIG. 2, wherein the body portion has a flat bottom 32, then the bottoms 34 of the blades are flat to conform therewith. However, given an eave or gutter which is semicircular, round or curved in cross section, then the blades would be of a complementary cross-section configuration so that the bottom walls 34, instead of being flat, would be curved.

The tool 12 is moved to and fro or back and forth within a gutter, as indicated by the arrows 36 in FIG. 3 by means of an elongated handle 38 which is attached to the tool by a U-bracket 40. The bracket 40 has opposing legs 42 and 44 which terminate in beveled free ends 46 that lie flat against the inner ends of the bottoms 34 of the blades on opposite sides of the center section 14 with the inner or lower end portions 48 of the legs 42 and 44 being fixedly attached to the legs 16 and 18 of the center section 14 of the tool by means of bolts or rivets 50. By virtue of the configuration and manner of attachment of the legs of the supporting brackets 40 to the center section of the tool, the bracket is disposed at approximately a 45° angle to the tool and projects upwardly therefrom and angularly thereform so as to extend upwardly and outwardly beyond the outer wall 52 of the gutter, as shown, for example, in FIG. 2. This disposes the handle 38 outwardly of the gutter or eave and clear from the outer wall 52 thereof whereby the handle can be moved back and forth without contacting the gutter and in a way so that the ends 28 of the blade dig into the compacted leaves and debris and force the same onto the blades. The tool can then be lifted upwardly and outwardly from the gutter by raising the handle 38 and the captive leaves and debris can be discharged onto the ground.

As shown in FIG. 1, the upper end 54 of the handle 38 is beveled so that it fits snugly against the inner face of the bight portion 56 of the bracket 40 with the upper end portion of the handle being fixed to the upper ends of the legs 40 and 42 adjacent to bight portion 56 by means of bolts, rivets or other fasteners 58.

It can thus be appreciated that a very simple and easily operated implement is provided for cleaning leaves and other debris from overhead gutters or eaves. The implement is of an extremely lightweight nature and can be moved back and forth by an operator, while standing on the ground, in a manner so that the operator does not become tired. The simple construction of the cleaning implement enables it to be easily manufactured and to be inexpensively marketed. The nature of the tool, the bracket and the handle enable them to be made from many different and inexpensive construction materials of a lightweight but sturdy nature.

While the best known form of the present invention has been described herein and shown in the accompanying drawing, it is to be understood that such is for exemplary purposes only and that the invention is only limited by the scope and spirit of the appended claims.

What is claimed is:

1. An implement for cleaning the overhead roof gutter of a building comprising:

(a) a tool positionable in the gutter and composed of oppositely extending coplanar channel-like blades having outer open ends and inner ends and having a raised center section joining the inner ends;

(b) a bracket fixed to the center section and extending angularly upwardly and outwardly therefrom;

(c) an elongated handle having an end attached to the bracket and depending therefrom when the tool is positioned in a gutter with the handle being held by a person on the ground and moved so as to move the tool back and forth in the gutter, and;

(d) said blades and center section being integral and formed from one piece of stock with the center section being U-shaped and having legs upstanding from the inner ends of the blades.

2. The implement of claim 1 wherein the bracket is U-shaped and has legs with outer free beveled end portions fixedly attached to the outer sides of the legs of the center section with the bracket extending outwardly approximately 45° from the center section.

3. The implement of claim 2 wherein the handle has an upper end attached to the outer end of the bracket and fixedly depending therefrom.

4. The implement of claim 3 wherein the handle has a beveled upper end that abuts the inner face of the bight portion of the bracket and means fixedly attaching the handle to the legs of the bracket adjacent the bight portion.

5. The implement of claim 4 wherein the blades are of a cross-sectional shape to conform to the cross-sectional shape of the gutter body.

6. The implement of claim 4 wherein the blades have bottoms with upstanding side edges.

* * * * *